US008382486B2

(12) United States Patent
Lee et al.

(10) Patent No.: US 8,382,486 B2
(45) Date of Patent: Feb. 26, 2013

(54) SELF-ORIENTING ELECTRICAL CONNECTOR

(75) Inventors: John Jong-Suk Lee, Waterloo (CA); William Donald Santo, Waterloo (CA); Sherman Wang, Kitchener (CA)

(73) Assignee: Research In Motion Limited, Waterloo, Ontario (CA)

( * ) Notice: Subject to any disclaimer, the term of this patent is extended or adjusted under 35 U.S.C. 154(b) by 29 days.

(21) Appl. No.: 12/975,625

(22) Filed: Dec. 22, 2010

(65) Prior Publication Data

US 2012/0164849 A1 Jun. 28, 2012

(51) Int. Cl.
*H01R 11/30* (2006.01)

(52) U.S. Cl. ..... 439/39

(58) Field of Classification Search ..... 439/38, 439/39, 11, 13, 21, 17, 26, 29; 381/330; 200/51.09

See application file for complete search history.

(56) References Cited

U.S. PATENT DOCUMENTS

| | | | | |
|---|---|---|---|---|
| 3,144,527 | A * | 8/1964 | Tolegian | 200/51.09 |
| 3,521,216 | A * | 7/1970 | Tolegian | 439/39 |
| 3,786,391 | A * | 1/1974 | Mathauser | 439/39 |
| 3,808,577 | A * | 4/1974 | Mathauser | 439/39 |
| 4,026,618 | A * | 5/1977 | Straka | 439/21 |
| 4,211,456 | A * | 7/1980 | Sears | 439/39 |
| 4,690,495 | A | 9/1987 | Giannini | |
| 5,401,175 | A | 3/1995 | Guimond et al. | |
| 5,454,724 | A * | 10/1995 | Kloeppel et al. | 439/17 |
| 6,625,297 | B1 | 9/2003 | Bradley | |
| 6,748,094 | B1 * | 6/2004 | Tziviskos et al. | 381/330 |
| 6,993,153 | B2 | 1/2006 | Bradley | |
| 7,264,479 | B1 | 9/2007 | Lee | |
| 7,311,526 | B2 * | 12/2007 | Rohrbach et al. | 439/39 |
| 7,329,128 | B1 | 2/2008 | Awad | |
| 7,607,920 | B1 * | 10/2009 | Chen | 439/39 |
| 7,637,746 | B2 * | 12/2009 | Lindberg et al. | 439/38 |
| 7,641,477 | B2 * | 1/2010 | DiFonzo et al. | 439/39 |
| 2006/0246742 | A1 * | 11/2006 | Sun | 439/11 |

FOREIGN PATENT DOCUMENTS

| | | |
|---|---|---|
| DE | 202008013600 | 12/2008 |
| DE | 102008038641 | 3/2009 |
| FR | 2859828 | 3/2005 |

OTHER PUBLICATIONS http://en.wikipedia.org/wiki/MagSafe, MagSafe, retrieved Nov. 24, 2010.

(Continued)

*Primary Examiner* — Alexander Gilman
(74) *Attorney, Agent, or Firm* — Rowand LLP

(57) ABSTRACT

An electrical connector and electronic device for connecting to a complementary electrical connector are provided. The electrical connector comprises a main body containing one or more electrically conducting mediums. The electrical connector also comprises an end piece rotatably connected to the main body at one end of the main body. The end piece has a connecting side for engaging the complementary electrical connector. The end piece is rotatable about an axis of rotation. The connecting side comprises one or more electrical contacts for engaging complementary electrical contacts on the complementary electrical connector. Each electrical contact of the electrical connector is electrically connected to one of the electrically conducting mediums of the main body. The connecting side also comprises a magnet disposed on the connecting side of the end piece for engaging a complementary magnet on the complementary electrical connector.

20 Claims, 11 Drawing Sheets

OTHER PUBLICATIONS http://ieeexplore.ieee.org/Xplore/login.jsp?url=http://ieeexplore.ieee.org/iel5/2220/4246021/04246035.pdf%3Farnumber%3D4246035&authDecision=-201, IEEE Xplore, retrieved Nov. 24, 2010.

http://www.aepconnectors.com/3509.html, Applied Engineering Products,retrieved Nov. 24, 2010.

http://www.youtube.com/watch?v=v_9vaL0sLbo, "Magic Magnetic Coupler for Tesla CD Turbine", uploaded Oct. 22, 2007.

http://vimeo.com/2213582—uploaded Nov. 11, 2008).

http://www.passtheball.com/ideas/view/id/1708—posted Jul. 25, 2009, Pass the Ball.

http://www.vpi.us/usb-gender-flex.html—first accessed on Mar. 8, 2010), VPI, Video Products Inc.

http://www.geek24.com/g/2006/07/17/flexusb-the-bending-rotating-usb-adapter—posted Jul. 17, 2006.

http://lifehacker.com/210373/diy-magnetic-power-connector—posted on Oct. 26, 2006), Lifehacker.

http://www.instructables.com/id/ThinkSafe%3a-A-Magnetic-Power-Connector-for-Thinkpad/—first commented on. Oct. 26, 2006, Instructables.

http://supportapple.com/kb/HT1630, Apple Portables: Reducing Cable Strain on your MagSafe Power Adapter, modified Sep. 9, 2009.

http://www.maplin.co.uk/searchtemplate.asp?criteria=USB%20MULTI%20ADAPTERS, Maplin, retrieved Nov. 24, 2010.

http://www.usb.org/developers/docs/ecn1.pdf, USB 2.0 Specification Engineering Change Notice (ECN) #1: Mini-B Connector, Oct. 20, 2000.

http://www.instructables.com/id/ThinkSafe:-A-Magnetic-Power-Connector-for-Thinkpad/, Instructables, retrieved Nov. 24, 2010.

Extended European Search Report dated May 25, 2011, EP10196424.

* cited by examiner

SELF-ORIENTING ELECTRICAL CONNECTOR

TECHNICAL FIELD

The present disclosure relates to electrical connectors and more particularly to a self orienting electrical connector.

BACKGROUND

Electrical connectors, such as data cables, are frequently used to establish a data connection between electronic devices. For example, Universal Serial Bus ("USB") connectors are frequently connected to electronic devices, such as, for example, computers or computer peripherals.

USB connectors and other data connectors typically include a female connector installed on an electronic device which receives a corresponding male connector which may be installed, for example, on a data cable.

Since the male connector is physically inserted into the female connector, the connectors may become damaged if the male connector is accidentally impacted. Furthermore, in order to physically insert the male connector into the female connector, the connectors must be properly aligned. Aligning the connectors is sometimes difficult where one of the connectors is obscured. For example, USB connectors are often provided on a back-side of desktop computers. In such cases, users are sometimes faced with the difficult task of inserting a USB data cable into a complementary connector which is not visible.

Thus, there exists a need for improved electronic connectors.

BRIEF DESCRIPTION OF THE DRAWINGS

It will be noted that throughout the drawings and description similar features are identified by the same reference numerals.

DETAILED DESCRIPTION OF EXAMPLE EMBODIMENTS

Figure 1:
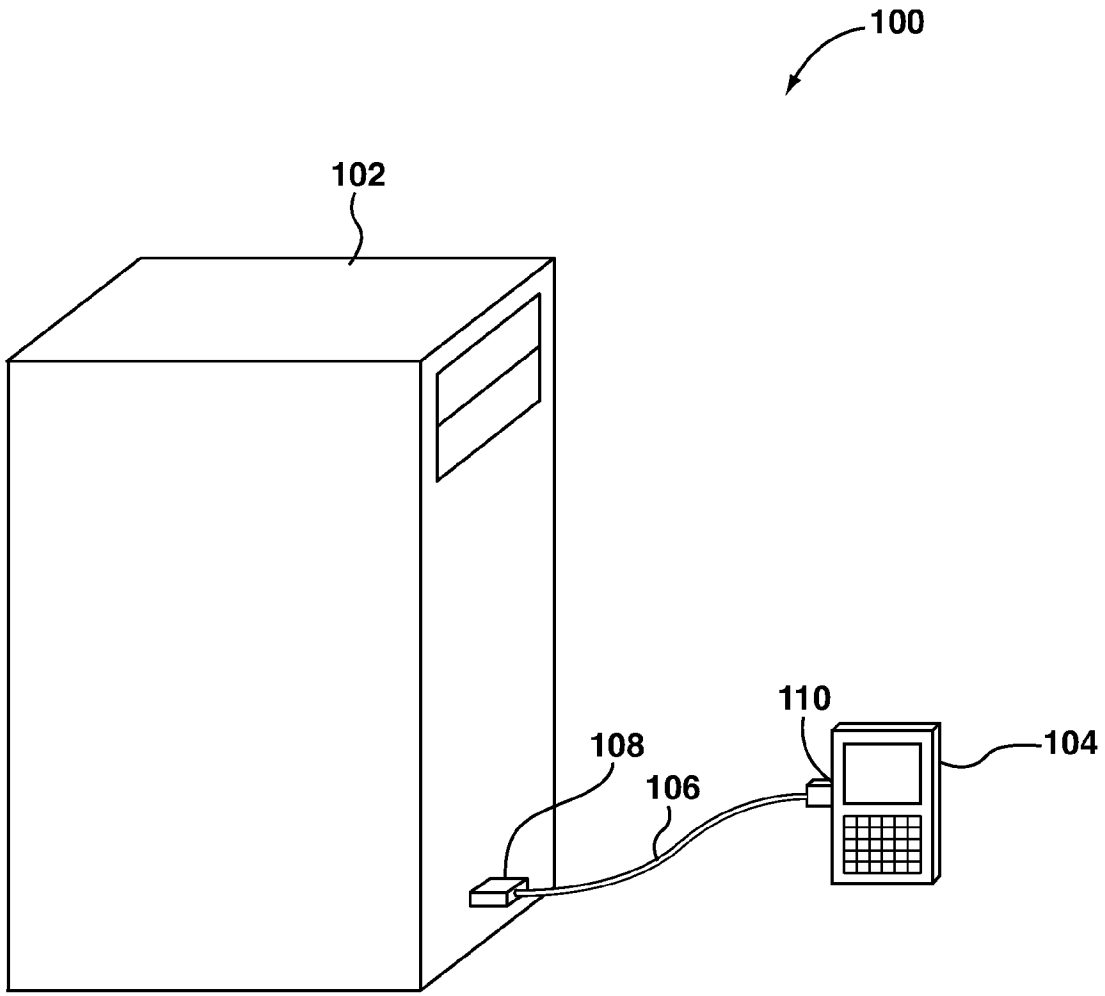
FIG. 1 is a system diagram illustrating an operating environment in which example embodiments of the present disclosure can be applied.

The present disclosure describes an electrical connector for connecting to a complementary electrical connector. The electrical connector comprises a main body containing one or more electrically conducting mediums. The electrical connector also comprises an end piece rotatably connected to the main body at one end of the main body. The end piece has a connecting side for engaging the complementary electrical connector. The end piece is rotatable about an axis of rotation. The connecting side comprises one or more electrical contacts for engaging complementary electrical contacts on the complementary electrical connector. Each electrical contact of the electrical connector is electrically connected to one of the electrically conducting mediums of the main body. The connecting side also comprises a magnet disposed on the connecting side of the end piece for engaging a complementary magnet on the complementary electrical connector. The magnet on the connecting side has at least one pole which is located at a position on the connecting side which is offset from the axis of rotation.

In another aspect, the present disclosure describes an electronic device. The electrical device comprises an electrical connector for connecting to a complementary electrical connector. The electrical connector comprises a main body containing one or more electrically conducting mediums. The electrical connector also comprises an end piece rotatably connected to the main body at one end of the main body. The end piece has a connecting side for engaging the complementary electrical connector. The end piece is rotatable about an axis of rotation. The connecting side comprises one or more electrical contacts for engaging complementary electrical contacts on the complementary electrical connector. Each electrical contact of the electrical connector is electrically connected to one of the electrically conducting mediums of the main body. The connecting side also comprises a magnet disposed on the connecting side of the end piece for engaging a complementary magnet on the complementary electrical connector. The magnet on the connecting side has at least one pole which is located at a position on the connecting side which is offset from the axis of rotation. In yet a further aspect, the present disclosure describes an electrical connection retrofit device. The electrical connection retrofit device comprises a magnetic electrical connecting end. The magnetic electrical connecting end comprises one or more electrical contacts for engaging corresponding electrical contacts on a magnetic electrical connector and a magnet for engaging a corresponding magnet on a magnetic electrical connector. The electrical connection retrofit device further comprises a non-magnetic electrical connecting end. The non magnetic electrical connecting end comprises one or more electrical contacts for engaging one or more corresponding electrical contacts on a complementary non-magnetic electrical connector. The electrical connection retrofit device further comprise an electrically conductive medium connecting the electrical contacts on the magnetic electrical connecting end to corresponding electrical contacts on the non-magnetic electrical connecting end.

In a further aspect, the present disclosure describes a first electrical connector for connecting to a complementary second electrical connector. The first electrical connector comprises a main body containing one or more electrically conducting mediums. The first electrical connector further comprises an end piece connected to the main body at one end of the main body. The end piece has a connecting side for engaging the second electrical connector. The connecting side includes a magnet disposed on the connecting side and two or more electric connectors comprised of two or more electrically conductive concentric circles, the electrically conductive circles being centered around the magnet.

Other example embodiments of the present application will be apparent to those of ordinary skill in the art from a review of the following detailed description in conjunction with the drawings.

In order to facilitate an understanding of one possible environment in which example embodiments described herein can operate, reference is first made to FIG. 1 which shows an operating environment 100 in which example embodiments of the present disclosure can be applied. The operating environment 100 includes a first electronic device 102 and a second electronic device 104.

In the example embodiment illustrated, the first electronic device 102 is a desktop computer and the second electronic device 104 is a smartphone. In other example embodiments, the first electronic device 102 and/or the second electronic device 104 may be of another type. For example, in various embodiments, the first electronic device 102 or the second electronic device 104 may be, for example, any of: a desktop computer, a notebook or laptop style computer, a tablet or slate computing device, a computer of another type, a global positioning system, a mobile communication device such as a smartphone, a personal digital assistant ("PDA"), a peripheral, such as a printer, scanner, headset, a hard drive, flash drive or other storage device. The first electronic device 102 and/or the second electronic device 104 may also be of another type not specifically listed above.

An electrical connector 106 is used to connect the first electronic device 102 to the second electronic device 104. The electrical connector 106 provides a data connection between the first electronic device 102 and the second electronic device 104. The data connection is used to provide data communications between the first electronic device 102 and the second electronic device 104. For example, the data connection permits the first electronic device 102 to send communications to and receive communications from the second electronic device 104 and permits the second electronic device 104 to send and receive communications from the first electronic device 102. The electrical connector 106 may be referred to as a data connector.

The electrical connector 106 is received, at the first electronic device 102 by a first complementary electrical connector 108 which is provided by the first electronic device 102. That is, the electrical connector 106 engages the first complementary electrical connector 108 of the first electronic device 102. The first complementary electrical connector 108 is, in at least some embodiments, installed in the first electronic device 102 and communicatably connected to a processor (not shown) of the first electronic device 102; for example, through a communications bus.

The electrical connector 106 may also be received, at the second electronic device 104 by a second complementary electrical connector 110 which is provided by the second electronic device 104. That is, the electrical connector 106 engages the second complementary electrical connector 110 of the second electronic device 104. The second complementary electrical connector is, in at least some embodiments, installed in the second electronic device 104 and communicatably connected to a processor (not shown) of the second electronic device 104; for example, through a communications bus.

In at least some example embodiments, the electrical connector 106 may be used for providing electrical power from the first electronic device 102 to the second electronic device 104. In such embodiments, the first complementary electrical connector 108 of the first electronic device 102 may be electrically connected to a power source (not shown) associated with the first electronic device 102. Similarly, the second complementary electrical connector 110 of the second electronic device 104 may be electrically connected to power features (not shown) of the second electronic device 104. The power features may, for example, include a battery interface which uses electrical power supplied by the first electronic device 102 to charge a battery associated with the second electronic device 104. The power features may, in some embodiments, include circuitry which allows the second electronic device 104 to use the first electronic device 102 as a power source when the second electronic device 104 is connected to the first electronic device 102 via the electrical connector 106.

Figure 2:
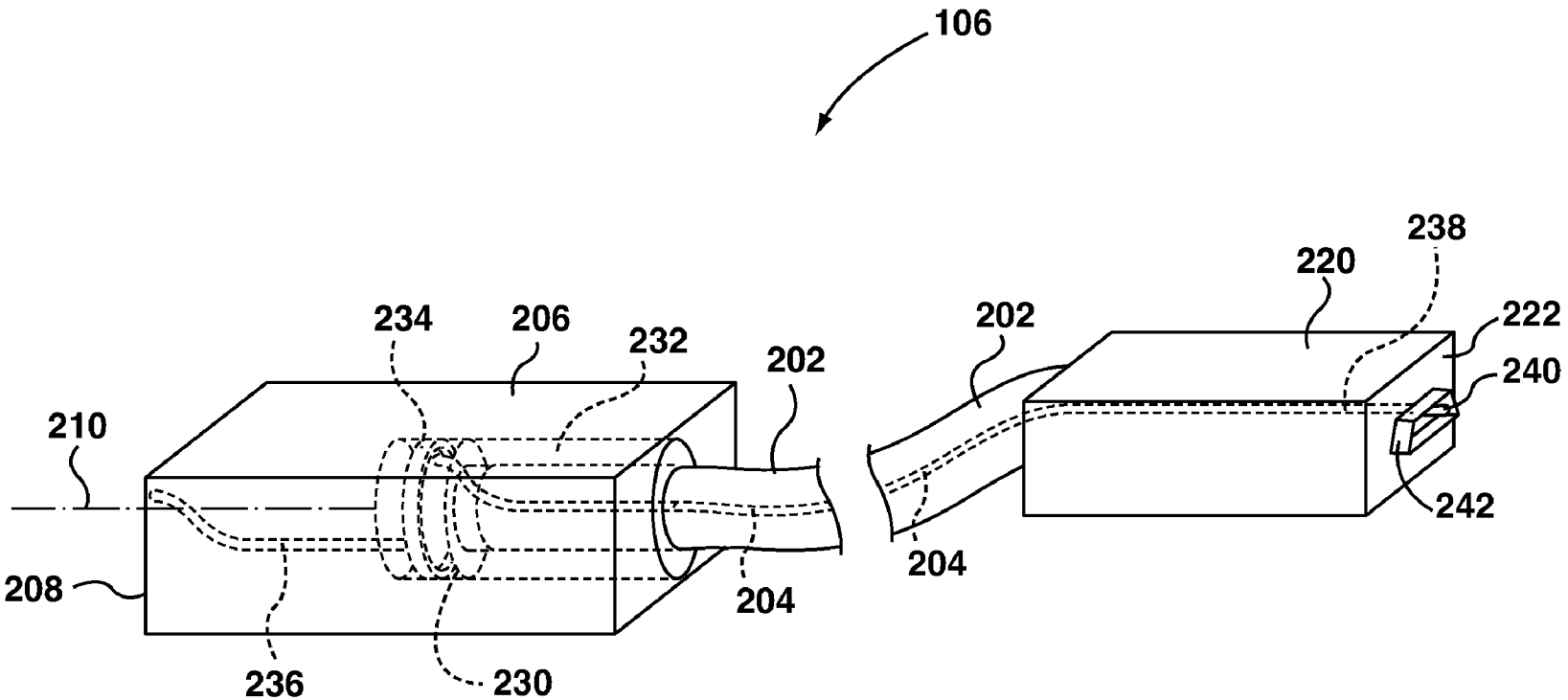
FIG. 2 is a perspective view of an electrical connector in accordance with example embodiments of the present disclosure.
Figure 3:
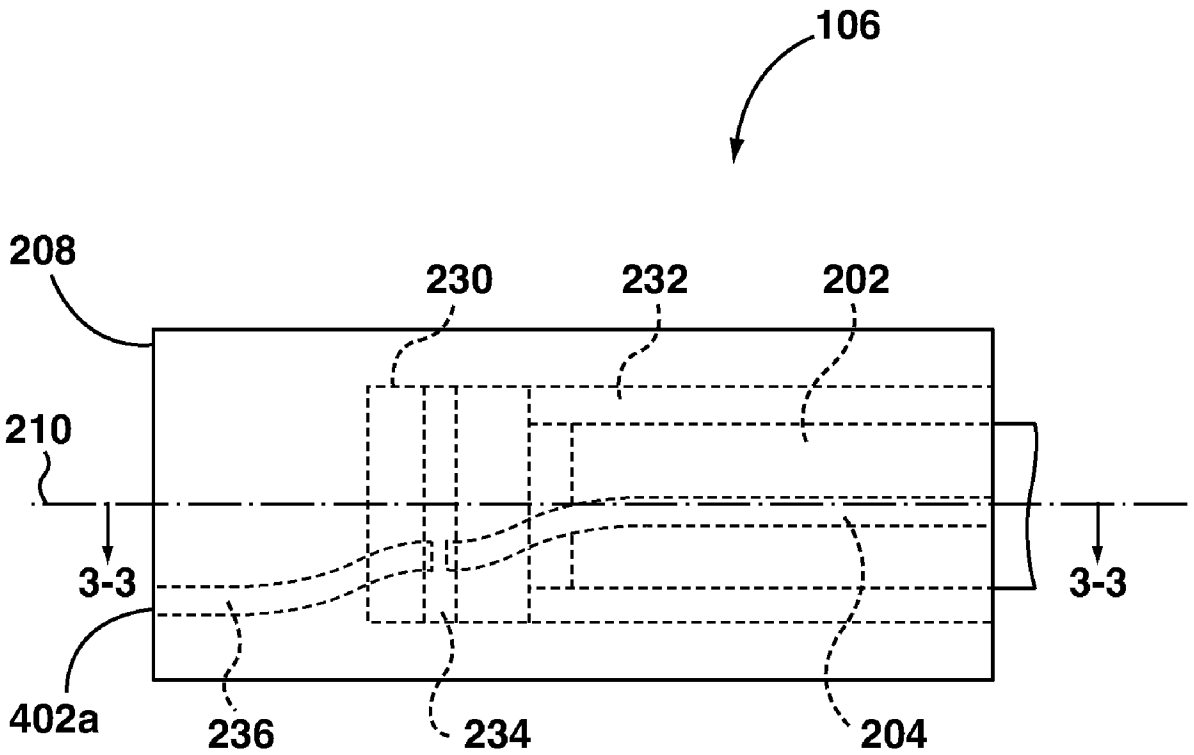
FIG. 3 is a partial top view of the electrical connector of FIG. 2 in accordance with example embodiments of the present disclosure.
Figure 4:
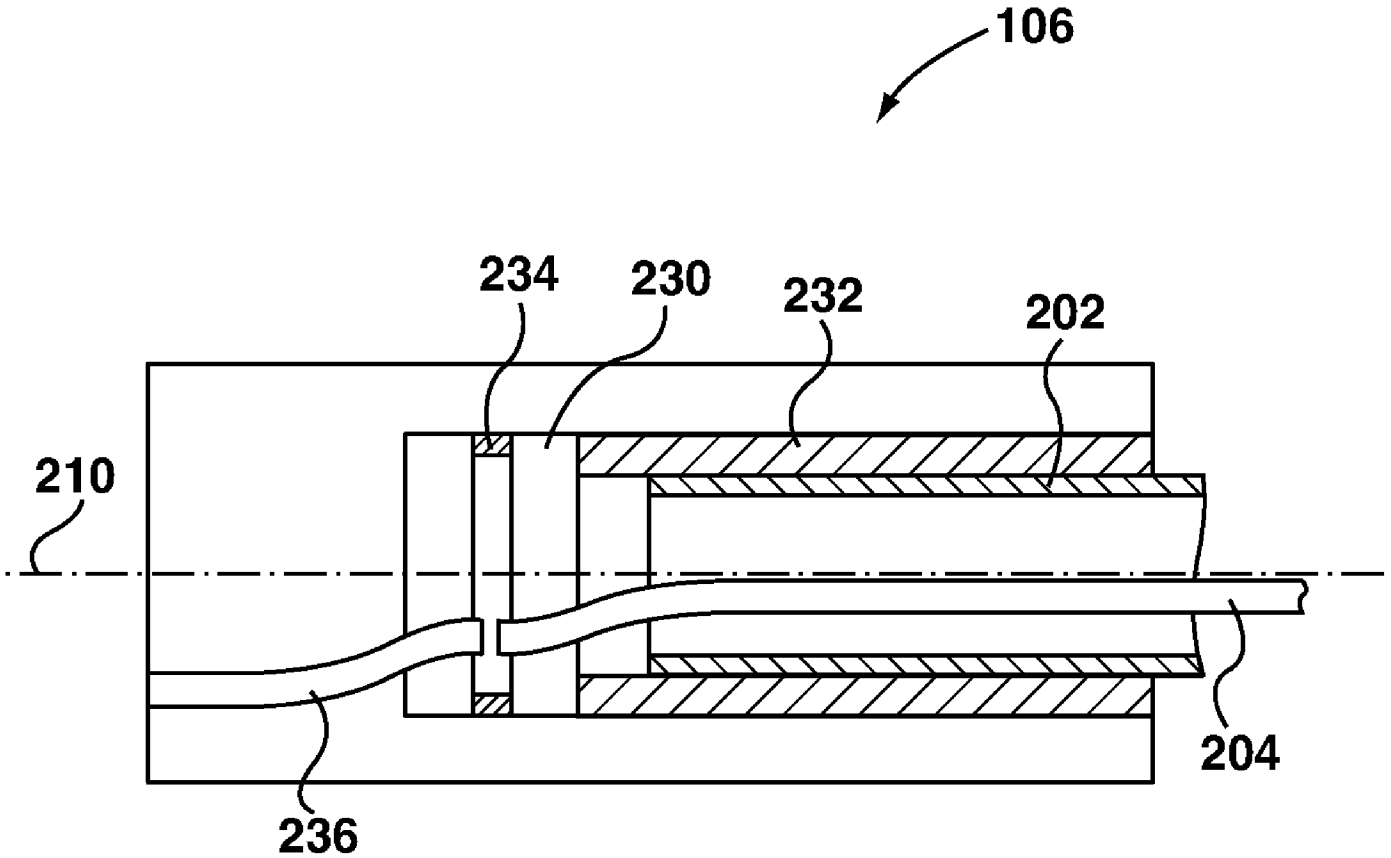
FIG. 4 is a cross sectional view of the electrical connector of FIGS. 2 and 3 taken along line 3-3 of FIG. 3, in accordance with example embodiments of the present disclosure.

An overview having been provided, reference will now be made to FIGS. 2 to 4 which further illustrate an electrical connector 106 in accordance with some example embodiments of the present disclosure. FIG. 2 illustrates a perspective view of an electrical connector 106. FIG. 3 illustrates a partial top view of the electrical connector 106 of FIG. 2. FIG. 4 illustrates a cross-sectional view of the electrical connector 106 of FIGS. 2 and 3 taken along line 3-3 of FIG. 3. FIG. 4 illustrates a front view of the electrical connector 106 of FIG. 2.

Referring first to FIG. 2, the electrical connector 106 includes a main body 202 which contains one or more electrically conductive mediums 204. In the embodiment of FIG. 2, the main body 202 is an electrical cable and the electrically conductive mediums 204 include one or more wires. While a single electrically conductive medium 204 is illustrated in FIG. 2, in practice, the cable will typically contain multiple electrically conductive mediums. For example, the cable may contain two or more wires.

The electrical connector 106 includes an end piece 206. The end piece 206 is rotatably connected to the main body 202 at one end of the main body 202. That is, the end piece 206 is connected to the main body 202 so that it freely rotates about an axis of rotation 210. The axis of rotation 210 is, in at least some embodiments, located at a midpoint of the main body 202 where the main body 202 connects to the end piece 206. That is, in at least some example embodiments, the end piece 206 rotates about the midpoint of the main body 202.

To permit the end piece 206 to rotate, the end piece is provided with a rotating connector 232. The rotating connector 232 connects the end piece 206 to the main body 202 to permit the end piece 206 to rotate about the main body 202. Various types of rotating connectors 232 may be used. For example, in at least some embodiments, the rotating connector 232 is a modified bearing, which includes grippers on an interior side for gripping the main body 202 and which is connected to the end piece 206 on an exterior side of the rotating connector 232. The rotating connector 232 is also illustrated in the top view of FIG. 3 and is best illustrated in the cross-sectional view of FIG. 4.

As will be discussed in greater detail below with reference to FIG. 5, the end piece 206 includes one or more electrical contacts 402*a*, 402*b*, 402*c*, 402*d* (FIG. 5) disposed on a first connecting side 208 of the end piece 206. The electrical contacts of the end piece 206 are electrically connected to respective electrically conductive mediums 204 (i.e. wires) of the main body 202. For example, in the embodiment illustrated, the end piece 206 includes an electrically conductive mediums 236 which electrically connect to the electrically conductive mediums 204 of the main body 202 and also to the electrical contacts 402*a*, 402*b*, 402*c*, 402*d* (FIG. 5) of the end piece 206. In the embodiment illustrated, the electrically conductive medium 236 connects to a first electrical contact 402*a*.

While a single electrically conductive medium 236 is illustrated within the end piece of FIGS. 2 to 4, in practice, the end piece may contain more than one electrically conductive medium 236. The number of electrically conductive mediums 236 in the end piece 206 typically corresponds to the number of electrically conductive mediums 204 in the main body 202 and also the number of electrical contacts 402*a*, 402*b*, 402*c*, 402*d* on the end piece 206.

It will be appreciated that, if the electrically conductive mediums 204 (i.e. wires) of the main body (i.e. cable) are rigidly connected to the end piece (i.e. if the wires of the cable are rigidly connected to the electrically conductive medium 236 of the end piece 206), then the rotation of the end piece 206 may be impeded. Accordingly, in at least some embodiments, the electrically conductive mediums 204 of the main body are not rigidly connected to respective electrically conductive mediums 236 of the end piece 206. Instead, the end piece 206 may include an interior cavity which contains an electrical contact which wraps around the cavity. For example, in the embodiment illustrated, the end piece 206 contains a cylindrical interior 230 which contains one or more circular electrical contacts 234. The end piece 206 may contain a separate circular electrical contact 234 for each separate electrically conducting medium 204 in the main body. The circular electrical contact 234 wraps around the cylindrical interior 230, thus defining a circle. That is, the circular electrical contact 234 is a ring-like contact.

Each circular electrical contact 234 is rigidly connected to a corresponding electrically conductive medium 236 in the end piece 206. Each circular electrical contact 234 is not rigidly connected to a corresponding electrically conductive medium 204 in the main body 202. Instead, a portion of the electrically conductive medium 204 in the main body 202 which protrudes from the main body is biased against a respective circular electrical contact 234. The electrically conductive medium 204 may, in some embodiments, be self-biased against its respective circular electrical contact 234. For example, the electrically conductive medium 204 may be a rigid wire which is bent against the circular electrical contact 234. In other example embodiments, the electrically conductive medium may be held against the circular electrical contact 234 with a biasing feature (not shown). Thus, the end piece is permitted to move relative to the electrically conductive medium 204 in the main body, but an electrical connection is maintained between the circular electrical contact 234 and the electrically conductive medium 204 of the main body since the electrically conductive medium 204 of the main body is held against a point on the circle irrespective of the state of rotation of the end piece 206.

The biasing feature (not shown) may be provided in a variety of forms. For example, the biasing feature (not shown) may, in some embodiments, be provided by a leaf spring which biases the electrically conductive medium 204 of the main body 202 against the circular electrical contact 234.

In at least some embodiments, the electrical connector 106 may include a second end piece 220. In such embodiments, the end piece 206 which was discussed above may also be referred to as a first end piece 206. The second end piece 220 may be connected to the main body at an end of the main body which is opposite to the end where the first end piece 206 was connected.

The second end piece 220 includes a second connecting side 222. The second connecting side 222 is configured to connect to the second complementary electrical connector 110 (FIG. 1) of the second electronic device 104 (FIG. 1). In the embodiment shown in FIG. 2, the second end piece 220 is a non-magnetic connector. The second end piece 220 includes an electrically conductive medium 238 which connects the electrically conductive medium 204 of the main body 202 to electrical contacts 240 of the second end piece 220. While the electrically conductive medium 238 of the second end piece 220 is illustrated using a separate reference numeral from the electrically conductive medium 204 of the main body 202, in practice, the electrically conductive medium 238 of the second end piece 220 and the electrically conductive medium 204 of the main body 202 may be a common element, such as a wire which runs through the main body 202 and which connects directly to the electrical contacts 240 of the second end piece 220.

The electrical contacts 240 extend from a protruding section 242 of the second connecting side 222. The protruding section 242 is a male connector which may be received in a corresponding female electrical connector (i.e. the second complementary electrical connector 110 of FIG. 1) of the second electronic device 104 (FIG. 1). The protruding section 242 friction fits within the second complementary electrical connector 110 (FIG. 1) of the second electronic device 104 (FIG. 1). In at least some embodiments, the second end piece 220 is a micro-USB connector.

While FIG. 2 illustrates an embodiment in which the electrical connector 106 includes one magnetic type end piece (i.e. end piece 206) and one non-magnetic type end piece (i.e. second end piece 220), in other embodiments, the electrical connector 106 may include two magnetic type end pieces. That is, the second end piece 220 may, in some embodiments be of the type described in this document with reference to the first end piece 206 and the second complementary electrical connector 110 of the second electronic device 104 may be of the type described herein with reference to the first complementary electrical connector 108 of the first electronic device 102.

Figure 5:
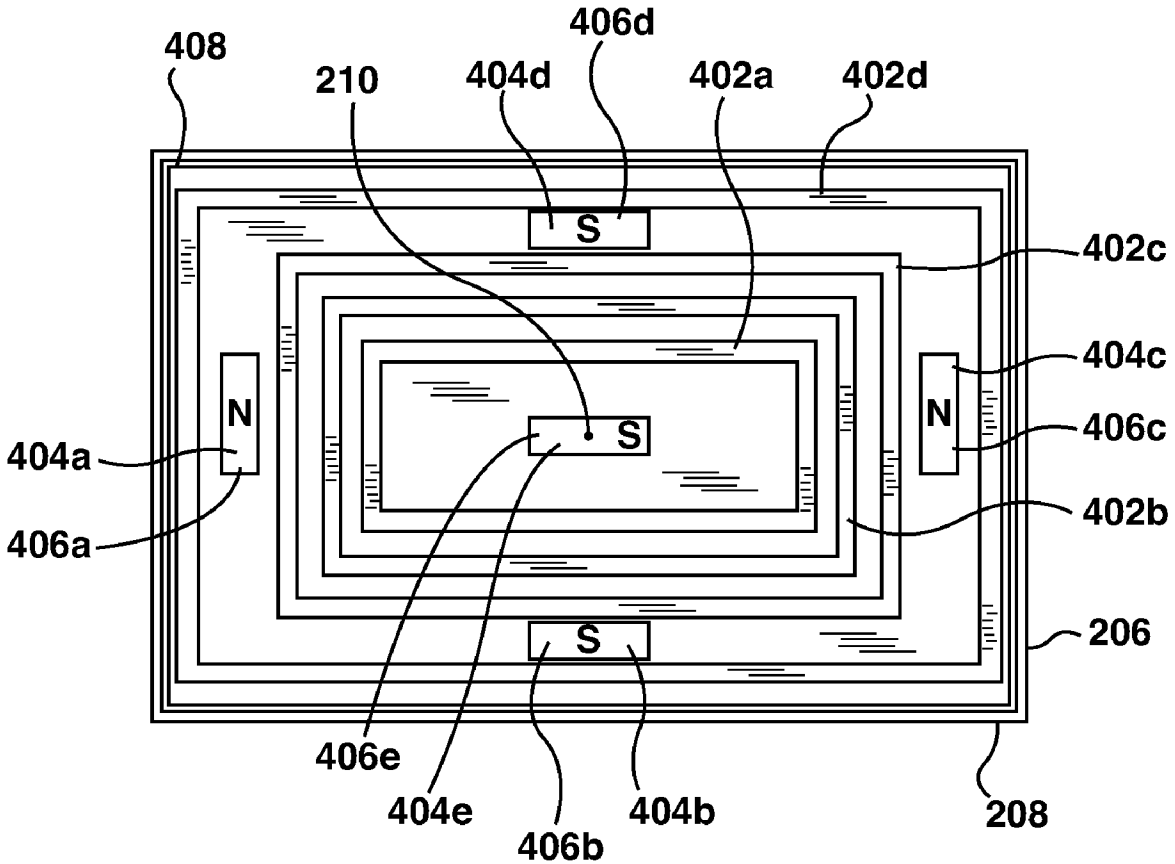
FIG. 5 is a front view of the electrical connector of FIG. 2 in accordance with example embodiments of the present disclosure.

Referring now to FIG. 5, a front view of the electrical connector 106 of FIGS. 2 to 4 is illustrated. More particularly, the front view illustrates a connecting side 208 of the electrical connector 106. The connecting side 208 includes one or more electrical contacts 402*a*, 402*b*, 402*c*, 402*d*. In the embodiment illustrated, there are four electrical contacts—a first electrical contact 402*a*, a second electrical contact 402*b*, a third electrical contact 402*c*, and a fourth electrical contact 402*d*. Each electrical contact 402*a*, 402*b*, 402*c*, 402*d* of the electrical connector 106 may be comprised of one or more lines forming a polygon or circle. In the embodiment illustrated, the polygon is a rectangle comprised of four lines.

The size of each of the polygons or circles is different. For example in the embodiment of FIG. 5, the second electrical contact 402*b* is larger than the first electrical contact 402*a*, the third electrical contact 402*c* is larger than the second electrical contact 402*b*, and the fourth electrical contact 402*d* is larger that the third electrical contact 402*c*.

Each of the electrical contacts 402*a*, 402*b*, 402*c*, 402*d* is of the same geometric shape. For example, in the embodiment of FIG. 5, each electrical contact is a rectangle. Each electrical contact 402*a*, 402*b*, 402*c*, 402*d* has a center point which is located at the axis of rotation 210 of the end piece 206.

In some example embodiments, the electrical contacts 402*a*, 402*b*, 402*c*, 402*d* may be formed from shapes or objects which have a rotational symmetry about the axis of rotation 210 of an order greater than one. A shape with rotational symmetry is one that appears the same after a certain degree of rotation. In the embodiment illustrated in FIG. 5, the rectangular electrical contacts 402*a*, 402*b*, 402*c*, 402*d* have a second order rotational symmetry about the axis of rotation 210. That is, the electrical contacts 402*a*, 402*b*, 402*c*, 402*d* appear the same in two different rotational positions. For example, where the end piece 206 is rotated one-hundred and eighty degrees from the position illustrated in FIG. 5, the electrical contacts will appear the same as they do in FIG. 5. Since the rectangular electrical contacts 402*a*, 402*b*, 402*c*, 402*d* appear the same in two separate rotational positions about the axis of rotation 210, they are of the second order.

By using electrical contacts 402*a*, 402*b*, 402*c*, 402*d* which have a rotational symmetry which is greater than one, in at least some embodiments, the electrical connector 106 may connect to the complementary electrical connector 108 in more than one rotational position.

The connecting side 208 of the end piece 206 of the electrical connector 106 also includes at least one magnet 404*a*, 404*b*, 404*c*, 404*d*, 404*e* disposed on the connecting side 208 of the end piece 206. At least one of the magnets 404*a*, 404*b*, 404*c*, 404*d* or 404*e* includes a magnetic pole 404*a*, 404*b*, 404*c*, 404*d*, 404*e* which is located at a position on the connecting side which is offset from the axis of rotation 210. For example, in the embodiment illustrated, a first magnet 404*a* has a first pole 406*a* which is offset from the axis of rotation. Similarly, a second magnet 404*c* has a second pole 406*b* which is offset from the axis of rotation, a third magnet 404*b* has a third pole 406*c* which is offset from the axis of rotation and a fourth magnet 404*d* has a fourth pole 406*d* which is offset from the axis of rotation.

As will be explained in greater detail below with reference to FIG. 6, the magnets 404*a*, 404*b*, 404*c*, 404*d* which have a pole 404*a*, 404*b*, 404*c*, 404*d* which is offset from the axis of rotation 210 may be used to provide self-aligning capabilities to the electrical connector 106. The magnets 404*a*, 404*b*, 404*c*, 404*d*, 404*e* may also be used to fasten the electrical connector 106 to a complementary electrical connector 108.

Where the magnets 404*a*, 404*b*, 404*c*, 404*d*, 404*e* are used to fasten the electrical connector 106 to the first complementary electrical connector 108, the magnets may include a magnet 404*e* which has a pole 406*e* which is not offset from the axis of rotation. For example, in the example illustrated, a fifth magnet 404*e* includes a fifth pole 406*e* which may be located at the axis of rotation. The fifth pole 406*e* may be used to fasten the electrical connector 106 to the first complementary electrical connector 108.

In the embodiment of FIG. 5, the electrical connector 106 includes five magnets. Four of the magnets 404*a*, 404*b*, 404*c*, 404*d* are located at a position which is offset from the axis of rotation 210. The fifth magnet 404*e* is located at the center of the axis of rotation 210. In the embodiment illustrated, a first magnet 404*a* and a second magnet 404*c* are located near the shorter sides of the rectangular electrical contacts 402*a*, 402*b*, 402*c*, 402*d*. A third magnet 404*b* and a fourth magnet 404*d* are located near the longer sides of the rectangular electrical contacts 402*a*, 402*b*, 402*c*, 402*d*. The first magnet 404*a* and the second magnet 404*c* have exposed poles 406*a*, 406*c* which are of a first polarity (in the embodiment illustrated, they are magnetic north), and the third magnet 404*b* and the fourth magnet 404*d* have exposed poles 406*b*, 406*d* which are of a second polarity, which is opposite the first polarity (in the embodiment illustrated, they are magnetic south).

In other example embodiments, other magnet layouts may be used. For example, in one example embodiment (not illustrated), the connecting side 208 may include a single magnet with a pole offset from the axis of rotation 210.

In other example embodiments (not illustrated), the connecting side 208 may include two magnets with poles offset from the axis of rotation 210. The two magnets may each have a single exposed pole—a first magnet may include a first exposed pole and a second magnet may contain a second exposed pole. The first exposed pole may have a polarity which is opposite the polarity of the second exposed pole. The term exposed pole has been used to refer to a pole in which the magnetic field of that pole is exposed to elements which are external to the connector housing the magnet containing that pole.

In at least some embodiments, the connecting side 208 of the electrical connector 106 may include one or more aligning features 408. The aligning features prevent the electrical connector from contacting the first complementary electrical connector 108 in such a way that electrical contacts 402*a*, 402*b*, 402*c*, 402*d* on the electrical connector 106 may contact an electrical contact 502*a*, 502*b*, 502*c*, 502*d* (FIG. 6) on the first complementary electrical connector which does not correspond to that electrical contact 402*a*, 402*b*, 402*c*, 402*d* on the electrical connector 106.

The aligning feature 408 may, for example, be a rectangular protrusion or recess with a center point which is the same as the center point of the rectangles which form the electrical contacts 402*a*, 402*b*, 402*c*, 402*d*. As will be explained below with reference to FIG. 6, the aligning feature 408 of the electrical connector 106 interacts with a corresponding aligning feature 508 of the complementary electrical connector 108.

The connecting side 208 of the electrical connector 106 engages a complementary connecting side 510 of the complementary electrical connector 108. The complementary connecting side 510 of the complementary electrical connector 108 is a part of the complementary electrical connector 108 of the first electronic device 102 which may be exposed by the first electronic device 102. A front view of a complementary electrical connector 108 is illustrated in FIG. 6.

The complementary connecting side 510 of the complementary electrical connector 108 includes features which align with the features of the connecting side 208 of the electrical connector 106.

For example, the complementary connecting side 510 includes complementary electrical contacts 502*a*, 502*b*, 502*c*, 502*d* which engage the electrical contacts 402*a*, 402*b*, 402*c*, 402*d* of the connecting side 208 of the electrical connector 106. That is, when the electrical connector 106 of FIGS. 2 to 5 is connected to the complementary electrical connector 108 of FIG. 6, the electrical contacts 402*a*, 402*b*, 402*c*, 402*d* of the electrical connector 106 contact respective electrical contacts 502*a*, 502*b*, 502*c*, 502*d* of the complementary electrical connector 108 thus providing electrical communication between the contacts. That is, the first electrical contact 402*a* engages a first complementary electrical contact 502*a*. Similarly, the second electrical contact 402*b* engages a second complementary electrical contact 502*b*, the third electrical contact 402*c* engages a third complementary electrical contact 502*c*, and the fourth electrical contact 402*d* engages a fourth complementary electrical contact 502*d*.

Accordingly, in at least some embodiments, the complementary electrical contacts 502*a*, 502*b*, 502*c*, 502*d* of the complementary electrical connector 108 are of a size and shape which correspond to the size and shape of the respective electrical contacts 402*a*, 402*b*, 402*c*, 402*d*. For example, in at least some embodiments, each complementary electrical contact 502*a*, 502*b*, 502*c*, 502*d* of the complementary electrical connector 108 may be comprised of one or more lines forming a polygon or circle. In the embodiment illustrated, the polygon is a rectangle comprised of four lines.

The size of each of the polygons or circles is different for each complementary electrical contact 502*a*, 502*b*, 502*c*, 502*d*. For example in the embodiment of FIG. 6, the second complementary electrical contact 502*b* is larger than the first complementary electrical contact 502*a*, the third complementary electrical contact 502*c* is larger than the second complementary electrical contact 502*b*, and the fourth complementary electrical contact 502*d* is larger that the third complementary electrical contact 502*c*.

Each of the complementary electrical contacts 502*a*, 502*b*, 502*c*, 502*d* is of the same geometric shape. For example, in the embodiment of FIG. 6, each complementary electrical contact is a rectangle.

The complementary electrical connector 108 also includes one or more complementary magnets 504*a*, 504*b*, 504*c*, 504*d*, 504*e* disposed on the complementary connecting side 510. The complementary magnets 504*a*, 504*b*, 504*c*, 504*d*, 504*e* have complementary poles 506*a*, 506*b*, 506*c*, 506*d*, 506*e* respectively. The complementary magnets 504*a*, 504*b*, 504*c*, 504*d*, 504*e* are disposed on the complementary connecting side 510 so that, when the electrical connector 106 is connected to the complementary electrical connector 108, the complementary magnets 504*a*, 504*b*, 504*c*, 504*d*, 504*e* each engage a corresponding magnet 404*a*, 404*b*, 404*c*, 404*d*, 404*e* on the electrical connector 106. That is, when the electrical connector 106 is connected to the complementary electrical connector 108, the complementary poles 506*a*, 506*b*, 506*c*, 506*d*, 506*e* of the complementary electrical connector 108 each engage a corresponding pole 406*a*, 406*b*, 406*c*, 406*d*, 406*e* (which is of the opposite polarity as the complementary pole 506*a*, 506*b*, 506*c*, 506*d*) on the complementary electrical connector 108. Each pole on the electrical connector 106 engages a corresponding pole on the complementary electrical connector 108 which is located at the same relative position, but which has an opposite polarity.

Since the poles 406*a*, 406*b*, 406*c*, 406*d* of the electrical connector 106 are offset from the axis of rotation 210, an external magnetic field (which is produced by the magnets on the complementary electrical connector 108 on the first electronic device 102) may be applied to the poles 406*a*, 406*b*, 406*c*, 406*d* to cause the end piece 206 to rotate about the axis of rotation 210. Thus, the magnets may be used to self-align the electrical connector 106 with the first complementary electrical connector 108.

The magnets 404*a*, 404*b*, 404*c*, 404*d*, 404*e* and corresponding complementary magnets 504*a*, 504*b*, 504*c*, 504*d*, 504*e* may also be used to connect the electrical connector 106 to the first complementary electrical connector 108. That is, a magnetic attraction force produced as a result of the magnetic fields of the magnets 404*a*, 404*b*, 404*c*, 404*d*, 404*e* and complementary magnets 504*a*, 504*b*, 504*c*, 504*d*, 504*e* on the first complementary electrical connector 108 may be used to fasten the electrical connector 106 to the first complementary electrical connector 108.

By using magnets instead of a traditional friction fit electrical connector, the connecting side 208 of the end piece 206 may be flat, or substantially flat across its surface. The aligning feature 908 may, for example, be a circular protrusion or recess with a center point which is the same as the center point of the concentric circles which form the electrical contacts 902*a*, 902*b*, 902*c*, 902*d*. As will be explained below with reference to FIG. 11, the aligning feature 908 of the electrical connector 106 interacts with a corresponding aligning feature 1008 of the complementary electrical connector 108.

In at least some embodiments, the connecting side 208 of the electrical connector 106 is flat across its surface, with the exception of the portion of the surface which includes an aligning feature 408. The portion of the surface which includes an aligning feature 408 may be raised or lowered relative to the other portions of the surface.

That is, the end piece may not include a protruding male connector or a recessed female connector. Similarly, the complementary connecting side 510 of the complementary electrical connector may also be flat or substantially flat across its surface. The use of flat connecting sides may reduce the buildup of dust and other debris.

The use of a magnetic connection instead of a friction fit connection may protect electrical equipment, such as the electrical connector 106 from damage. When traditional connectors are connected, a force must be applied in a single direction in order to remove a male connector from a female connector. That is, the force must be applied directly away from the female connector. When a force is applied in another direction (for example, if a user accidentally impacts the connector) the connector may be damaged. By using a magnetic connector, the electrical connector 106 may be removed from a complementary electrical connector 108, even if the force is not applied directly away from the complementary connector.

The complementary electrical connector 108 may also include one or more aligning features 508 which correspond to the aligning features 408 of the electrical connector 106. The aligning features prevent each of the electrical contacts 502*a*, 502*b*, 502*c*, 502*d* on the complementary electrical connector 108 from contacting a non-corresponding electrical contact 402*a*, 402*b*, 402*c*, 402*d* on the electrical connector 106. That is, the aligning features fervent the electrical connector 106 from contacting the first complementary electrical connector 108 in such a way that an electrical contact 402*a*, 402*b*, 402*c*, 402*d* on the electrical connector 106 may contact an electrical contact 502*a*, 502*b*, 502*c*, 502*d* (FIG. 6) on the first complementary electrical connector which does not correspond to that electrical contact 402*a*, 402*b*, 402*c*, 402*d* on the electrical connector 106. The aligning feature 508 may, for example, be a rectangular protrusion or recess with a center point which is the same as the center point of the rectangles which form the electrical contacts 402*a*, 402*b*, 402*c*, 402*d*. The aligning feature 408 of the electrical connector 106 interacts with a corresponding aligning feature 508 of the complementary electrical connector 108. Other aligning features are also possible.

For example the aligning features 408, 508 may allow the first electrical contact 402*a* on the electrical connector 106 to contact the first complementary electrical contact 502*a* on the complementary electrical connector 108, while preventing it from contacting the second complementary electrical contact 502*b*, the third complementary electrical contact 502*c*, and/or the fourth complementary electrical contact 502*d*. Similarly, the aligning features 408, 508 may allow the second electrical contact 402*b* on the electrical connector 106 to contact the second complementary electrical contact 502*b* on the complementary electrical connector, while preventing it from contacting the first complementary electrical contact 502*a*, the third complementary electrical contact 502*c* and/or the fourth complementary electrical contact 502*d*. Similarly, the aligning features 408, 508 may allow the third electrical contact 402*c* on the electrical connector 106 to contact the third complementary electrical contact 502*c* on the complementary electrical connector, while preventing it from contacting the first complementary electrical contact 502*a*, the second complementary electrical contact 502*b* and/or the fourth complementary electrical contact 502*d*. Similarly, the aligning features 408, 508 may allow the fourth electrical contact 402*d* on the electrical connector 106 to contact the fourth complementary electrical contact 502*d* on the complementary electrical connector, while preventing it from contacting the first complementary electrical contact 502*a*, the second complementary electrical contact 502*b* and/or the third complementary electrical contact 502*c*.

In some embodiments (not shown), the aligning features 408 (FIG. 5), 508 (FIG. 6) may not be included on the electrical connector 106 and complementary electrical connector 108. Instead, in at least some embodiments, alignment may be provided by the magnetic features of the connectors 106, 108 alone.

In at least some embodiments, in order to provide a form factor which is similar to the form factor of standard Type A universal serial bus (USB) connectors, the connecting side 208 and the complementary connecting side 510 are rectangular and have a rectangular perimeter or substantially rectangular perimeter. In at least some embodiments, the connecting side 208 and complementary connecting side 510 are of a size which corresponds to the size of a type A universal serial bus connector.

In some applications, it may be desirable to use the electrical connector 106 described herein with a first electronic device 102 which may not have an integrated complementary electrical connector 108 of the type described above with reference to FIG. 6. Such electronic devices may, however, have other electrical connectors included therein. For example, as discussed above, non-magnetic connectors, such as USB ports, are often included in computers. Accordingly, in at least some embodiments, an electrical connection retrofit device may be used to convert a non-magnetic electrical connector into a magnetic electrical connector which is capable of receiving a magnetic electrical connector 106 of the type described herein.

Figure 7:
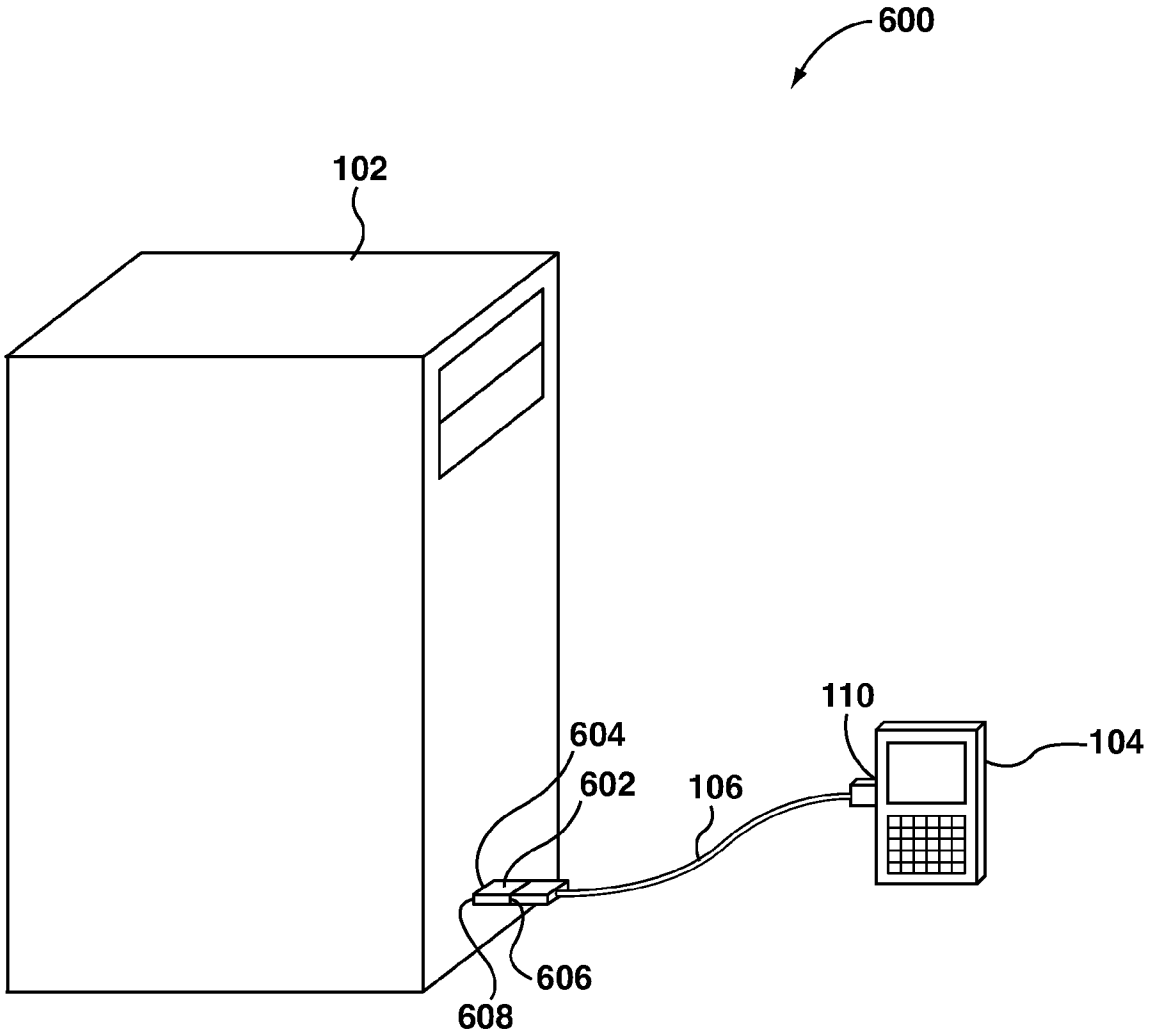
FIG. 7 is a system diagram illustrating an operating environment in which example embodiments of the present disclosure can be applied.

An overview having been provided, reference will now be made to FIG. 7 which illustrates an operating environment 600 according to example embodiments of the present disclosure. The operating environment 600 includes a first electronic device 102 and a second electronic device 104. In the embodiment of FIG. 7, the first electronic device 102 does not include a magnetic electrical connector of a type which is capable of connecting directly to a magnetic electrical connector 106. Instead, the first electronic device 102 includes a non-magnetic port 608. The non-magnetic port may, for example, be a USB port.

An electrical connection retrofit device 602 is used to allow the first electronic device 102 to connect to the electrical connector 106.

The electrical connection retrofit device 602 includes a non-magnetic electrical connecting end 604 which is configured to be inserted into the non-magnetic port 608 and a magnetic electrical connecting end 606 which is configured to connect to the magnetic electrical connector 106 at the connecting side 208.

Figure 8:
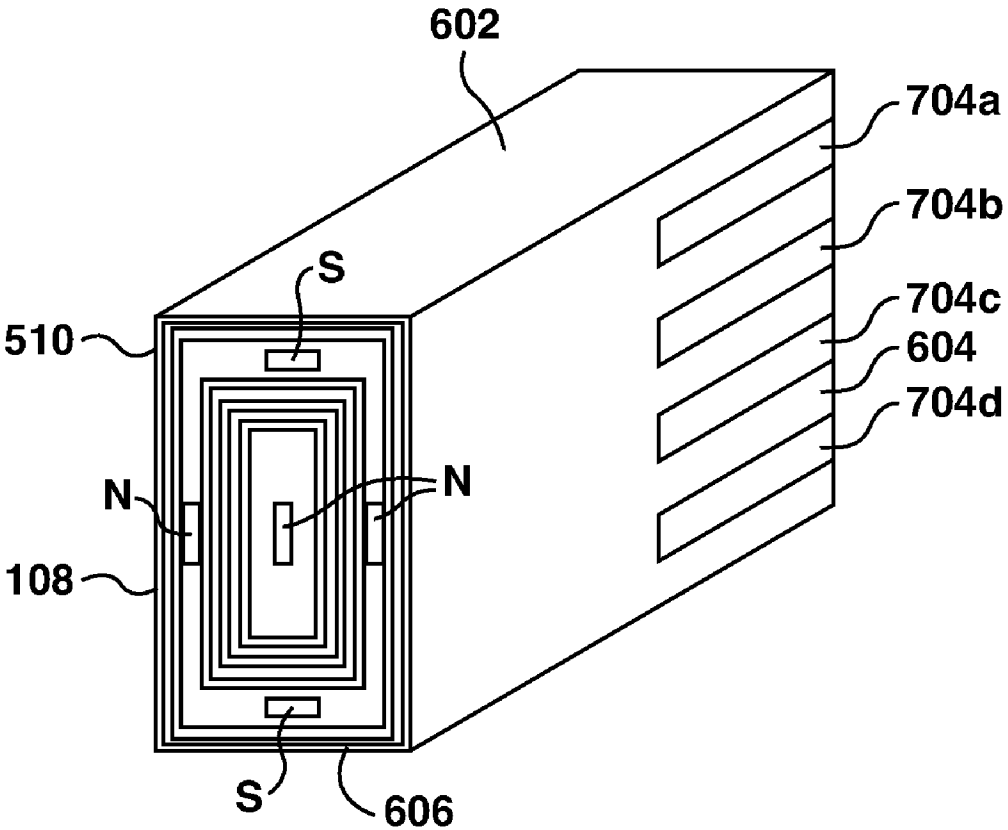
FIG. 8 is a perspective view of an electrical connection retrofit device in accordance with example embodiments of the present disclosure.

Referring now to FIG. 8, a perspective view of the electrical connection retrofit device 602 of FIG. 7 is illustrated. The electrical connection retrofit device 602 includes the non-magnetic electrical connecting end 604 and the magnetic electrical connecting end 606. The non-magnetic electrical connecting end 604 is, in the embodiment illustrated, a USB connector which is configured for insertion into a USB port. The non-magnetic electrical connecting end 604 includes one or more electrical contacts 704*a*, 704*b*, 704*c*, 704*d* which are configured to contact corresponding electrical contacts in the non-magnetic port 608 (FIG. 7) when the non-magnetic electrical connecting end 604 is inserted into the non-magnetic port 608 (FIG. 7). That is, the electrical contacts 704*a*, 704*b*, 704*c*, 704*d* of the non-magnetic electrical connecting end 604 are configured for engaging complementary electrical contacts on a complementary non-magnetic connector (such as the non-magnetic port 608).

Figure 6:
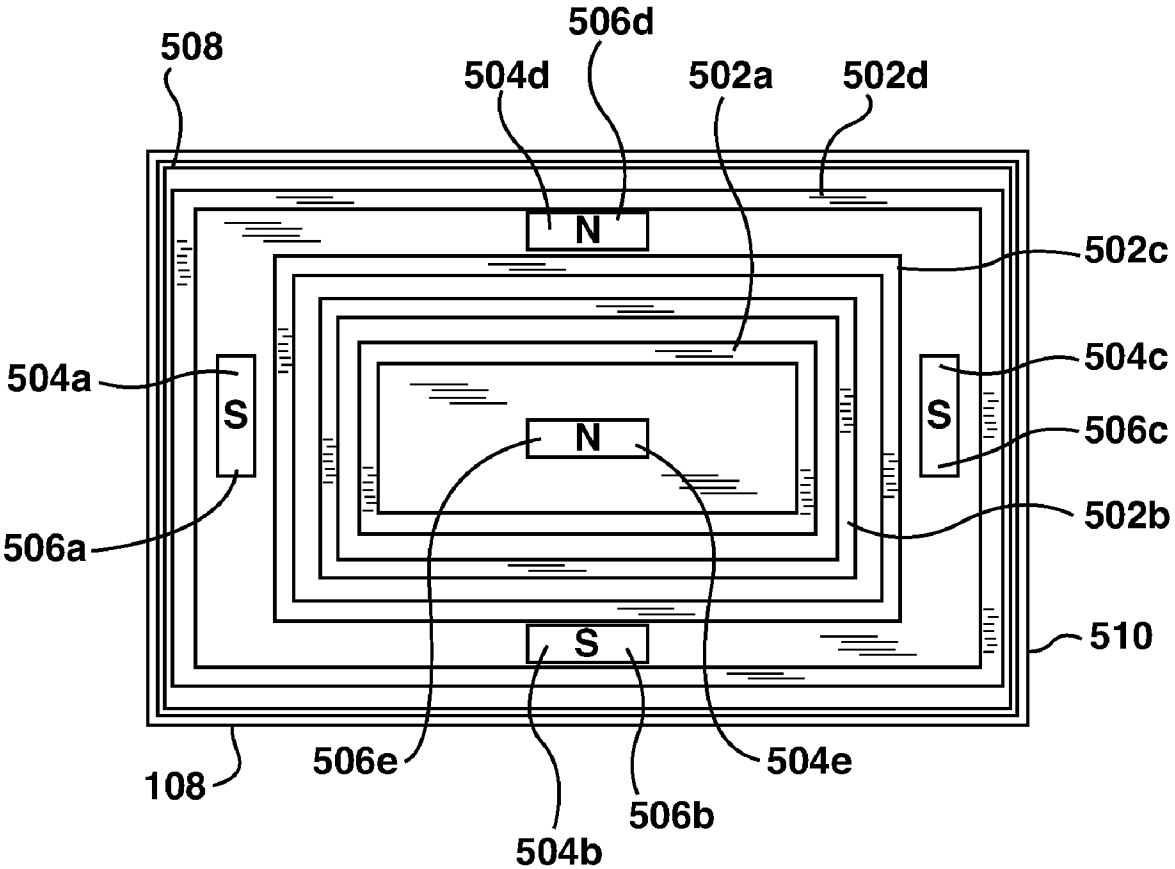
FIG. 6 is a front view of a complementary electrical connector for use with the electrical connector of FIGS. 2 to 5 in accordance with example embodiments of the present disclosure.

The magnetic electrical connecting end 606 acts as the first complementary electrical connector 108 described above and includes features described above with reference to the complementary electrical connector 108 of FIG. 6. More particularly, the magnetic electrical connecting end 606 includes one or more contacts 502*a*, 502*b*, 502*c*, 502*d* (FIG. 6) for engaging corresponding electrical contacts 402*a*, 402*b*, 402*c*, 402*d* (FIG. 5) on the magnetic electrical connector 106. The layout of the complementary electrical contacts 502*a*, 502*b*, 502*c*, 502*d* is described in greater detail above with reference to FIG. 6.

The electrical connection retrofit device 602 also includes one or more electrically conductive mediums (not shown) which internally connect electrical contacts 704*a*, 704*b*, 704*c*, 704*d* on the non-magnetic electrical connecting end 604 to corresponding electrical contacts 402*a*, 402*b*, 402*c*, 402*d* on the magnetic electrical connecting end 606.

The magnetic electrical connecting end 606 also includes one or more magnets 504*a*, 504*b*, 504*c*, 504*d*, 504*e* (FIG. 6) for engaging corresponding magnets 404*a*, 404*b*, 404*c*, 404*d*, 404*e* (FIG. 5) on the magnetic electrical connector 106. The layout of the magnets 504*a*, 504*b*, 504*c*, 504*d*, 504*e* is described in greater detail above with reference to FIG. 6.

Since USB ports are often located in close proximity to other USB ports on electronic devices 102, 104, in at least some embodiments, the electrical connection retrofit device 602 is sized so that it does not interfere with adjacent USB ports. Accordingly, in at least some embodiments, the electrical connection retrofit device 602 has a rectangular cross section which is of a size of typical USB connectors.

While the embodiments described above have generally described embodiments in which the end piece 206 of the electrical connector 106 is rotatably connected to a main body, in other embodiments, such rotating features may, instead, be provided on the complementary electrical connector 108 of an electronic device 102, 104 or an electrical connection retrofit device 602. That is, in some embodiments (not shown), the complementary electrical connector 108 may include a complementary connecting side 510 which rotates about a main body. In such embodiments, the electrical connector 106 may not have a rotating end piece 206.

Figure 9:
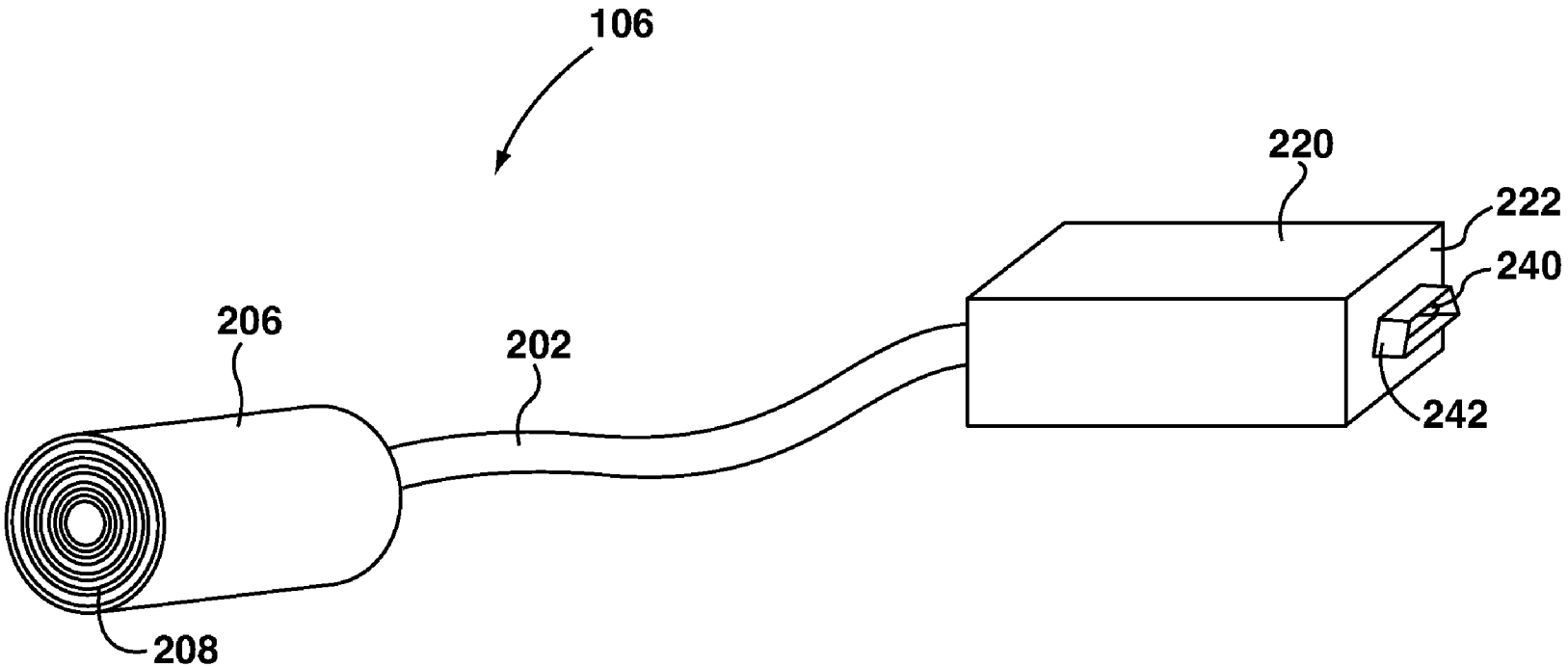
FIG. 9 is a perspective view of an electrical connector in accordance with further example embodiments of the present disclosure.

Referring now to FIG. 9, an electrical connector 106 in accordance with further embodiments of the present application is illustrated. The electrical connector 106 may be used in operating environments of the type described above with reference to FIGS. 1 and/or 7.

The electrical connector 106 includes a first end piece 206 which is connected to one end of a main body 202. Another end of the main body 202 is connected to a second end piece 220. The second end piece 220 may, in some embodiments (such as the embodiment illustrated), be a non-magnetic connector of the type described above with reference to FIG. 2. In other embodiments, the second end piece 220 may be a magnetic connector of the type described throughout this document.

In at least some embodiments, the end piece 206 may be non-rotatable relative to the main body 202. That is, the end piece 206 may be rigidly connected to the main body 202. As will be explained below with reference to FIGS. 10 and 11, in at least some embodiments, alignment of the electrical connector 106 with a complementary electrical connector may be provided through the use of electrical contacts which are in the form of concentric rings, and a magnet which is located at the centre of the concentric rings.

Figure 10:
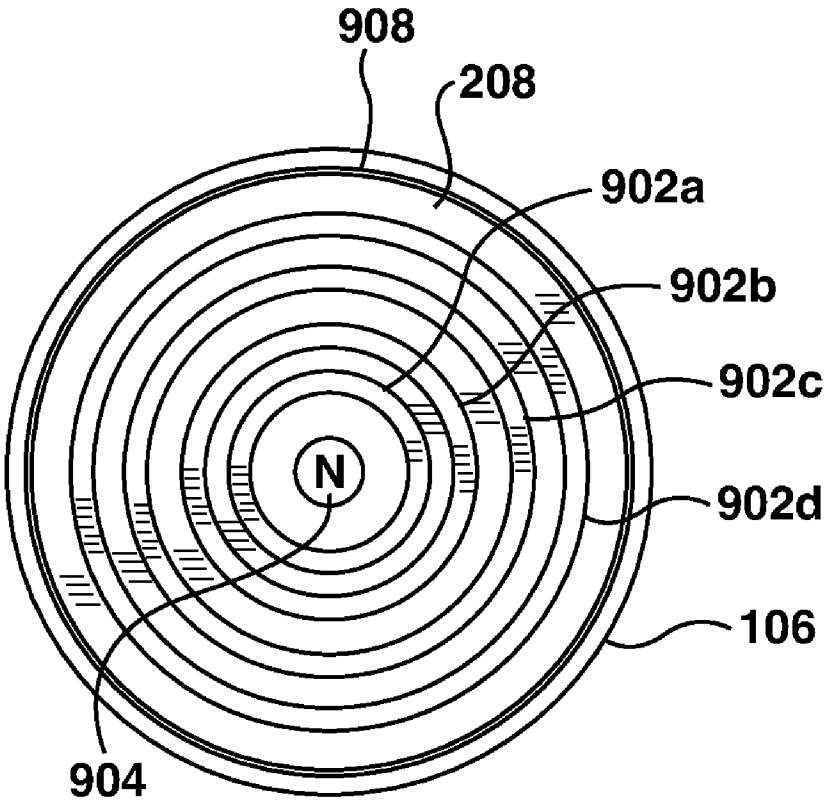
FIG. 10 is a front view of the electrical connector of FIG. 10 in accordance with example embodiments of the present disclosure.

Referring first to FIG. 10, a front view of the electrical connector 106 of FIG. 9 is illustrated. More particularly, a front view of a connecting side 208 of the electrical connector is illustrated. The connecting side 208 of the electrical connector 106 includes one or more electrical contacts 902*a*, 902*b*, 902*c*, 902*d*. The electrical contacts 902*a*, 902*b*, 902*c*, 902*d* are concentric circles. That is, the electrical contacts 902*a*, 902*b*, 902*c*, 902*d* are concentric circular lines. Each circle has a different size, but has the same center point.

The connecting side 208 of the electrical connector 106 also includes a circular magnet 904. The circular magnet 904 has a center point which is the center point of the concentric circles which form the electrical contacts 902*a*, 902*b*, 902*c*, 902*d*.

As discussed above with reference to FIG. 5, in at least some embodiments, the connecting side 208 includes one or more aligning features 908. The aligning features prevent the electrical connector 106 from contacting the first complementary electrical connector 108 in such a way that the electrical contacts 902*a*, 902*b*, 902*c*, 902*d* on the electrical connector 106 may contact a complementary electrical contact 1002*a*, 1002*b*, 1002*c*, 1002*d* (FIG. 11) on the first complementary electrical connector which does not correspond to that electrical contact 902*a*, 902*b*, 902*c*, 902*d* on the electrical connector 106. The aligning feature 908 may, for example, be a circular protrusion or recess with a center point which is the same as the center point of the concentric circles which form the electrical contacts 902*a*, 902*b*, 902*c*, 902*d*. As will be explained below with reference to FIG. 11, the aligning feature 908 of the electrical connector 106 interacts with a corresponding aligning feature 1008 of the complementary electrical connector 108.

The connecting side 208 is, in at least some example embodiments, flat or substantially flat across its surface.

Figure 11:
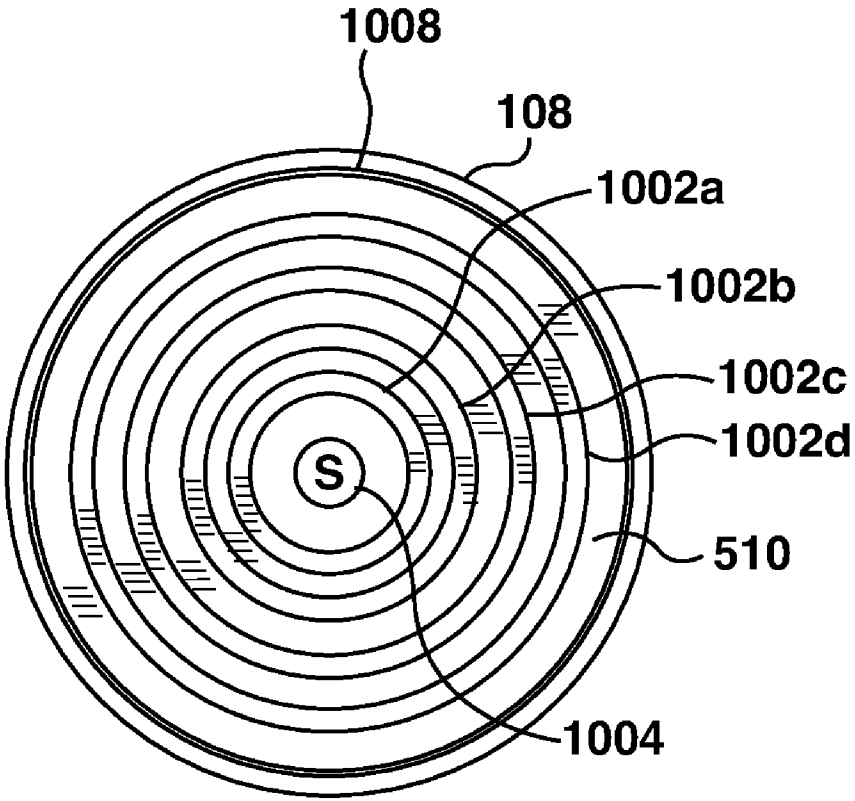
FIG. 11 is a front view of a complementary electrical connector for use with the electrical connector of FIG. 9 in accordance with example embodiments of the present disclosure.

Referring now to FIG. 11, a front view of a complementary connecting side 510 of a complementary electrical connector 108 for use with the electrical connector 106 of FIG. 10 is illustrated. The connecting side 208 of the electrical connector 106 of FIG. 10 engages the complementary connecting side 510 of the complementary electrical connector 108 illustrated in FIG. 11.

The complementary connecting side 510 of the complementary electrical connector 108 includes features which align with the features of the connecting side 208 of the electrical connector 106.

For example, the complementary connecting side 510 includes complementary electrical contacts 1002*a*, 1002*b*, 1002*c*, 1002*d* which engage the electrical contacts 902*a*, 902*b*, 902*c*, 902*d* of the connecting side 208 of the electrical connector 106. That is, when the electrical connector 106 of FIG. 10 is connected to the complementary electrical connector 108 of FIG. 11, the electrical contacts 902*a*, 902*b*, 902*c*, 902*d* of the electrical connector 106 contact respective complementary electrical contacts 1002*a*, 1002*b*, 1002*c*, 1002*d* of the complementary electrical connector 108 thus providing electrical communication between the contacts. That is, the first electrical contact 902*a* engages the first complementary electrical contact 1002*a*. Similarly, the second electrical contact 902*b* engages the second complementary electrical contact 1002*b*, the third electrical contact 902*c* engages the third complementary electrical contact 1002*c*, and the fourth electrical contact 902*d* engages the fourth complementary electrical contact 1002*d*.

Accordingly, the complementary electrical contacts 1002*a*, 1002*b*, 1002*c*, 1002*d* of the complementary electrical connector 108 are of a size and shape which corresponds to the size and shape of the respective electrical contacts 902*a*, 902*b*, 902*c*, 902*d*. More particularly, the complementary electrical contacts 1002*a*, 1002*b*, 1002*c*, 1002*d* are formed of concentric circles. The size of each of the circles for each of the complementary electrical contacts 1002*a*, 1002*b*, 1002*c*, 1002*d* is different, but the circles share a common center point.

In at least some embodiments, the complementary connecting side 510 of the complementary electrical connector 108 also includes a circular complementary magnet 1004. The circular complementary magnet 1004 has a center point which is the center point of the concentric circles which form the complementary electrical contacts 1002*a*, 1002*b*, 1002*c*, 1002*d*. The polarity of the pole of the complementary magnet 1004 which is exposed on the complementary connecting side 510 of the complementary electrical connector 108 is opposite to the polarity of the pole of the magnet 904 which is exposed on the connecting side 208 of the electrical connector 106. Thus, the complementary magnet 1004 and the magnet 904 experience a magnetic attractive force which causes the electrical connector 106 to be held against the complementary electrical connector 108. More particularly, the magnets 904, 1004 serve to hold electrical connector 106 in a position in which the electrical contacts 902*a*, 902*b*, 902*c*, 902*d* on the electrical connector 106 each contact a respective complementary electrical contact 1002*a*, 1002*b*, 1002*c*, 1002*d* on the complementary electrical connector 108 to provide electronic communication between the respective electrical contacts.

As discussed above, in at least some embodiments, the complementary connecting side 510 of the complementary electrical connector 108 includes one or more aligning features 1008 which interact with corresponding aligning features 908 of the electrical connector 106. The aligning features 908, 1008 prevent the electrical connector from contacting the first complementary electrical connector 108 in such a way that electrical contacts 902*a*, 902*b*, 902*c*, 902*d* on the electrical connector 106 may contact a complementary electrical contact 1002*a*, 1002*b*, 1002*c*, 1002*d* (FIG. 11) on the first complementary electrical connector which does not correspond to that electrical contact 902*a*, 902*b*, 902*c*, 902*d* on the electrical connector 106. The aligning feature 1008 may, for example, be a circular protrusion or recess with a center point which is the same as the center point of the concentric circles which form the complementary electrical contacts 1002*a*, 1002*b*, 1002*c*, 1002*d*. The circular protrusion or recess may be received or may receive the aligning feature 908 of the electrical connector 106 only when the electrical connector 106 is properly aligned with the complementary electrical connector 108.

The complementary connecting side 510 of the complementary electrical connector 108 is flat or substantially flat across its surface.

The magnets 404*a*, 404*b*, 404*c*, 404*d*, 404*e* (FIG. 5), 504*a*, 504*b*, 504*c*, 504*d*, 504*e* (FIG. 5), 904 (FIG. 10) and 1004 (FIG. 11) described above may, in some embodiments, be permanent magnets such as, for example, rare earth magnets. In at least some embodiments, one or more of the magnets 404*a*, 404*b*, 404*c*, 404*d*, 404*e* (FIG. 5), 504*a*, 504*b*, 504*c*, 504*d*, 504*e* (FIG. 6), 904 (FIG. 10) and 1004 (FIG. 11) described above may be electro-magnets.

While the main body 202 of the electrical connectors described above has, generally, been illustrated as a cable which connects a first end piece 206 to a second end piece 220, in other embodiments, the main body may take other forms. For example in at least some embodiments, the main body is an electronic device, such as, for example, a flash memory device.

In accordance with some example embodiments of the present disclosure, there is provided an apparatus for establishing an electrical connection. The apparatus includes a first connector, which may be the electrical connector 106. The apparatus also includes a second connector, which may be the complementary electrical connector 108 described above.

In accordance with some example embodiments of the present disclosure, there is also provided an electronic device which includes an electrical connector. The electrical connector of the electronic device may, for example, be the electrical connector 106 described above or the complementary electrical connector 108 described above.

The example embodiments of the present disclosure described above are intended to be examples only. Those of skill in the art may effect alterations, modifications and variations to the particular embodiments without departing from the intended scope of the present disclosure. In particular, features from one or more of the above-described embodiments may be selected to create alternate embodiments comprised of a sub-combination of features which may not be explicitly described above. In addition, features from one or more of the above-described embodiments may be selected and combined to create alternate embodiments comprised of a combination of features which may not be explicitly described above. Features suitable for such combinations and sub-combinations would be readily apparent to persons skilled in the art upon review of the present disclosure as a whole. The subject matter described herein and in the recited claims intends to cover and embrace all suitable changes in technology.

The invention claimed is:

1. An electrical connector for connecting to a complementary electrical connector, the electrical connector comprising:

a main body containing one or more electrically conducting mediums; and an end piece rotatably connected to the main body at one end of the main body, the end piece having a connecting side for engaging the complementary electrical connector, the end piece being rotatable about an axis of rotation, the connecting side comprising:

one or more electrical contacts for engaging complementary electrical contacts on the complementary electrical connector, each electrical contact of the electrical connector being electrically connected to one of the electrically conducting mediums of the main body; and a magnet disposed on the connecting side of the end piece for engaging a complementary magnet on the complementary electrical connector, the magnet on the connecting side having at least one pole which is located at a position on the connecting side which is offset from the axis of rotation, the magnet producing a magnetic field which permits an external magnetic field to cause the end piece to rotate about the axis of rotation to self-align the electrical connector with the complementary electrical connector.

2. The electrical connector of claim 1, further comprising a second magnet disposed on the connecting side of the end piece for engaging a second complementary magnet on the complementary electrical connector, the second magnet having at least one pole which is located at a position on the connecting side which is offset from the axis of rotation.

3. The electrical connector of claim 1, wherein the connecting side is substantially flat.

4. The electrical connector of claim 1, wherein the electrical connector is configured for attaching to the complementary electrical connector using a magnetic field provided, at least in part, by the magnet disposed on the connecting side and the complementary magnet on the complementary electrical connector.

5. The electrical connector of claim 1, wherein the connecting side is substantially rectangular.

6. The electrical connector of claim 5, wherein the connecting side is of a size that corresponds to a size of a type A universal serial bus connector.

7. The electrical connector of claim 1, wherein the connecting side comprises two or more electrical contacts, and wherein the two or more electrical contacts each have rotational symmetry about the axis of rotation of an order greater than one, the electronic connector further comprising another magnet disposed on the connecting side of the end piece, the magnets producing magnetic fields which permit an external magnetic field to self-align the electrical connector by rotating the electrical connector to one of a plurality of rotational positions at which the electrical contacts are aligned with the complementary electrical contacts.

8. The electrical connector of claim 7, wherein the electrical contacts are each comprised of four lines forming a rectangle.

9. The electrical connector of claim 1, wherein the connecting side comprises two or more electrical contacts and wherein the two or more electrical contacts are comprised of two or more concentric circles having a center point defined by the axis of rotation.

10. The electrical connector of claim 1, further comprising: a second end piece connected to the main body at an end of the main body, the second end piece having a second connecting side for engaging a second complementary electrical connector.

11. The electrical connector of claim 1, wherein the end piece defines a cylindrical interior having at least one circular electrical contact for contacting one of the electrically conducting mediums.

12. An electrical connection retrofit device comprising:

a magnetic electrical connecting end, the magnetic electrical connecting end comprising one or more electrical contacts for engaging corresponding electrical contacts on a rotatable end piece of a magnetic electrical connector, the end piece being rotatable about an axis of rotation, the electrical contacts each having rotational symmetry about the axis of rotation of an order greater than one, the magnetic electrical connecting end further comprising magnets for engaging corresponding magnets disposed on the end piece of the magnetic electrical connector, the magnets producing magnetic fields which permit an external magnetic field to cause the end piece to rotate about the axis of rotation to self-align the magnetic electrical connector with the magnetic electrical connecting end by rotating the magnetic electrical connector to one of a plurality of rotational positions at which the electrical contacts of the magnetic electrical connecting end are aligned with the corresponding electrical contacts of the magnetic electrical connector;

a non-magnetic electrical connecting end, the non-magnetic electrical connecting end comprising one or more electrical contacts for engaging one or more corresponding electrical contacts on a complementary non-magnetic electrical connector; and an electrically conductive medium connecting the electrical contacts on the magnetic electrical connecting end to corresponding electrical contacts on the non-magnetic electrical connecting end.

13. The electrical connection retrofit device of claim 12, wherein the non-magnetic electrical connecting end is a universal serial bus connector.

14. An electronic device comprising:

an electrical connector for connecting to a complementary electrical connector, the electrical connector comprising:

a main body containing one or more electrically conducting mediums; and an end piece rotatably connected to the main body at one end of the main body, the end piece having a connecting side for engaging the complementary electrical connector, the end piece being rotatable about an axis of rotation, the connecting side comprising:

one or more electrical contacts for engaging complementary electrical contacts on the complementary electrical connector, each electrical contact of the electrical connector being electrically connected to one of the electrically conducting mediums of the main body; and a magnet disposed on the connecting side of the end piece for engaging a complementary magnet on the complementary electrical connector, the magnet on the connecting side having at least one pole which is located at a position on the connecting side which is offset from the axis of rotation, the magnet producing a magnetic field which permits an external magnetic field to cause the end piece to rotate about the axis of rotation to self-align the electrical connector with the complementary electrical connector.

15. The electronic device of claim 14, wherein the electrical connector further comprises: a second magnet disposed on the connecting side of the end piece for engaging a second complementary magnet on the complementary electrical connector, the second magnet having at least one pole which is located at a position on the connecting side which is offset from the axis of rotation.

16. The electronic device of claim 14, wherein the connecting side is substantially flat.

17. The electronic device of claim 14, wherein the electrical connector is configured for attaching to the complementary electrical connector using a magnetic field provided, at least in part, by the magnet disposed on the connecting side and the complementary magnet on the complementary electrical connector.

18. The electronic device of claim 14, wherein the connecting side comprises two or more electrical contacts and wherein the two or more electrical contacts each have rotational symmetry about the axis of rotation of an order greater than one, the electronic connector further comprising another magnet disposed on the connecting side of the end piece, the magnets producing magnetic fields which permit an external magnetic field to self-align the electrical connector by rotating the electrical connector to one of a plurality of rotational positions at which the electrical contacts are aligned with the complementary electrical contacts.

19. The electronic device of claim 14, wherein the electrical connector further comprises: a second end piece connected to the main body at an end of the main body, the second end piece having a second connecting side for engaging a second complementary electrical connector.

20. The electronic device of claim 14, wherein the end piece defines a cylindrical interior having at least one circular electrical contact for contacting one of the electrically conducting mediums.

* * * * *